United States Patent [19]

Perrott

[11] Patent Number: 4,702,173

[45] Date of Patent: Oct. 27, 1987

[54] VEHICLE SUPPORTED IN CANTILEVER FASHION AND SWITCHING OF AT RAIL DIVERGENT JUNCTIONS

[76] Inventor: Francis C. Perrott, The Manor House, South Cerney, Cirencester, England

[21] Appl. No.: 486,289

[22] PCT Filed: Aug. 6, 1982

[86] PCT No.: PCT/GB82/00246

§ 371 Date: Apr. 7, 1983

§ 102(e) Date: Apr. 7, 1983

[87] PCT Pub. No.: WO83/00466

PCT Pub. Date: Feb. 17, 1983

[30] Foreign Application Priority Data

Aug. 8, 1981 [GB] United Kingdom ..... 8124309
Jan. 22, 1982 [GB] United Kingdom ..... 8201812

[51] Int. Cl.[4] ..... E01B 25/06
[52] U.S. Cl. ..... 104/130; 104/96
[58] Field of Search ..... 104/96, 124, 130, 242, 104/243, 245, 247

[56] References Cited

U.S. PATENT DOCUMENTS 3,083,649 4/1963 Nelson ..... 104/121
3,780,666 12/1973 Perrott ..... 104/130 X
3,871,300 3/1975 Perrott ..... 104/130
3,890,904 6/1975 Edwards ..... 104/130 X
4,203,369 5/1980 Perrott ..... 104/130
4,214,535 7/1980 Gerhard ..... 104/130 X

FOREIGN PATENT DOCUMENTS 2047400 4/1971 Fed. Rep. of Germany .
1117681 6/1968 United Kingdom .
1354888 5/1974 United Kingdom .

*Primary Examiner*—Robert B. Reeves
*Assistant Examiner*—John G. Pido

[57] ABSTRACT

Transportation apparatus comprises a guideway and at least one vehicle on the guideway. The vehicle has an integral load-carrying compartment. The guideway includes a divergent junction and selectively operable switches to direct the vehicle to follow either the left hand or right hand path out of the junction. The vehicle has a bottom support adjacent the bottom of the load-carrying compartment and at both sides of the vehicle for engagement with lower support rails on the guideway. Cantilever supports engage upper guide surfaces provided on the guideway. The cantilever supports are duplicated on both sides of the vehicle and include one and the same upper follower, for engagement with an upper guide surface on the guideway, common to both of the cantilever supports so that the vehicle may be supported in cantilever fashion from either side on a single lower support rail and a single upper guide surface.

11 Claims, 37 Drawing Figures

Figure 1:
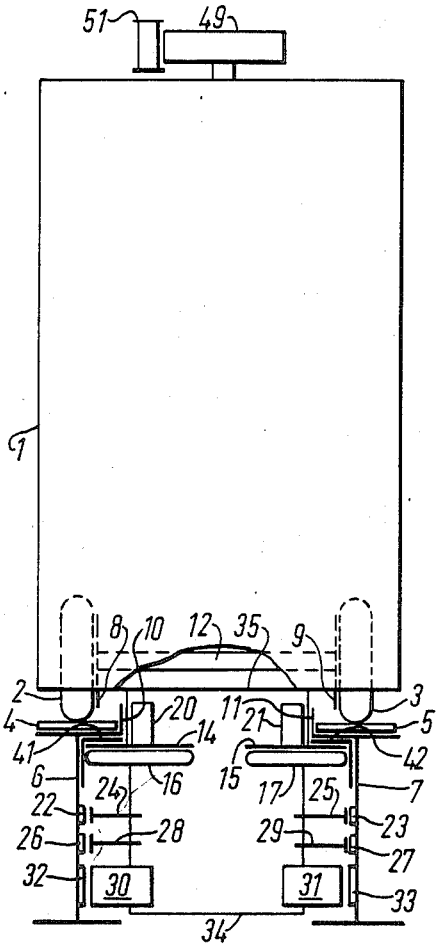

VEHICLE SUPPORTED IN CANTILEVER FASHION AND SWITCHING OF AT RAIL DIVERGENT JUNCTIONS

This invention relates to means of transportation and concerns guideways and vehicles providing transport for people or things. The guideways may be elevated structures, or may be at ground level or through tunnels. They support the vehicles, guide them and keep them upright.

Vehicle weight may be supported by any known means, such as pneumatic tyres, solid tires, steel cylindrical or coned wheels, magnetic levitation or air cushion. Guidance may be provided by any known means, for example any of the means last mentioned.

Urban passenger transport mostly uses buses, but these are suffering from road congestion. So called "rapid transit" is generally recognised to be better in principle, but its application is limited by capital cost. Capital cost is related to vehicle size, tunnel size and track specific load. Vehicle size has hitherto been determined by the capacity required. This invention aims to provide transportation means wherein trains may be substantially the same length as at present, but comprise smaller vehicles with better access running more frequently. This may be made possible by enabling people to get on and off quickly and easily.

Conventional rapid transit vehicles place seats along each outer wall. People stand in congested lines between the seats, and in larger areas close to the doors. The situation resembles a rugby scrum at every station during rush hours. People trying to get off have to fight their way out of the vehicle, firstly past those not wanting to alight and then past those already entering the vehicle. This "free-for-all" limits the frequency of trains by delaying them at stations. Delay makes people more determined than ever to get on board, and thus a vicious circle of diminishing returns is forced on everyone. The upshot is that, for all their theoretical capacity, most existing rapid transit systems spend relatively long periods non-productively static at stations, and more especially so at peak periods.

In embodiments according to the invention there may be provided relatively small vehicles, say 3 meters long by 1.5 meters wide, with seats at each end only, wide doors each side and standing room very close indeed to the doors. Each vehicle may carry, for example, twelve to fifteen passengers, of whom up to six may be seated. No passenger is more than approximately 1.3 meters from a door, and preferably passengers leave by one door and enter by a different door on the other side of the vehicle. Trains may comprise, for example, forty vehicles (that corresponds approximately to the length of a London Underground train at present). Passengers can leave freely, without conflict with people standing or entering. Those entering can do so right away, when space is available, and have no more than slightly over one meter to move inside the vehicle. This reduces the entering and leaving time at stations, and enables trains to run more frequently.

Such vehicles are required to be tall enough to accommodate standing passengers and narrow enough to keep people close to the doors. This makes them unstable with respect to lateral rolling, especially so because they are preferably light for economic reasons and may run in comparatively long trains. Other problems include traction, load distribution between so many automotive vehicles (i.e. each has a traction motor) and the choice between automatic or driver control. However those problems are no longer insuperable and this invention is to provide means to give transverse stability to very light vehicles, through improvements to guideways and vehicles, and to provide adequate transverse guidance for them to operate in long trains. This is especially important for operation on elevated guideways, where strong winds could cause derailment.

According to the invention there is provided means of transportation including a guideway comprising two horizontally spaced parallel rails each having an upper substantially horizontal flange on top of a substantially vertical web, at least one vehicle having bottom support means for movably supporting it on the upper flanges of the rails and guide means for lateral guiding engagement with the rails, whereby the vehicle is guided for travel along the track, and safety means mounted on the vehicle to underlie the substantially horizontal flanges of the rails and thereby prevent vertical displacement of the vehicle from the rails.

The invention also provides means of transportation including a guideway comprising upper and lower spaced parallel rails and at least one vehicle having means for movably supporting it from one side on said rails so that the vehicle extends laterally, in cantilever fashion, from the rails, each said rail being mounted on a beam structure extending parallel to the rail, said beam structure extending between, and being mounted on, a plurality of upright support columns spaced longitudinally of the beam structures, whereby the upper beam structure transmits to the columns a force exerted on the upper rail by the vehicle an acting outwardly away from the columns.

The invention further provides means of transportation comprising a guideway and at least one vehicle traversing said guideway, whereby at least one portion of said guideway provides bottom support at both sides of said vehicle and at least one other portion of said guideway supports said vehicle, in cantilever fashion, from one side only.

Figure 2:
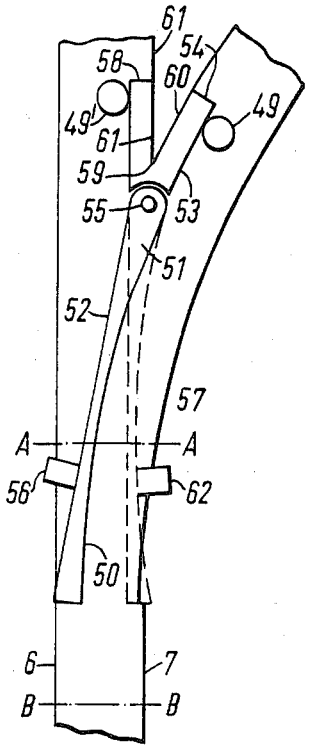
Figure 4:
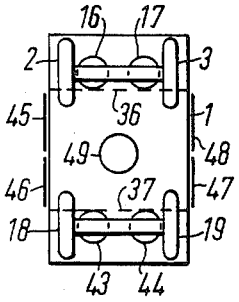
Figure 3:
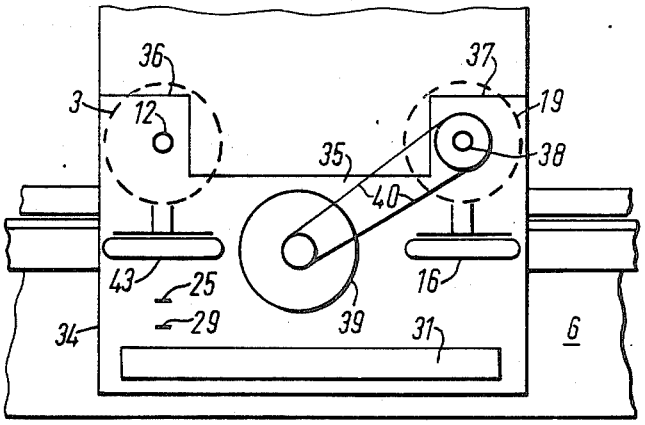
Figure 5:
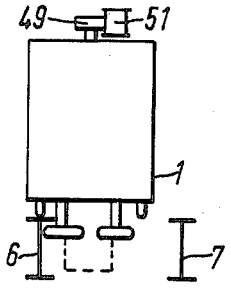
Figure 6:
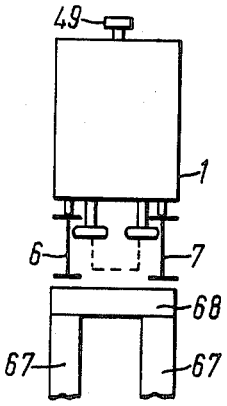
Figure 7:
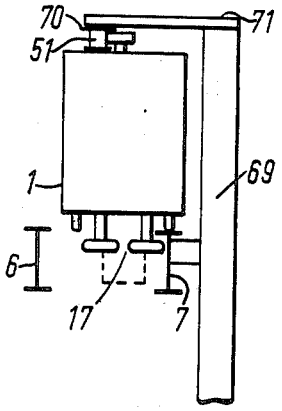
Figure 8:
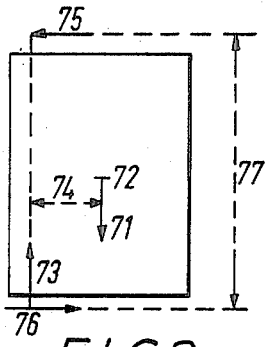
Figure 9:
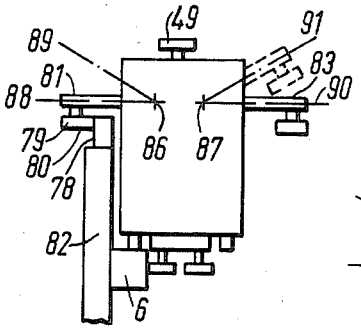
Figure 10:
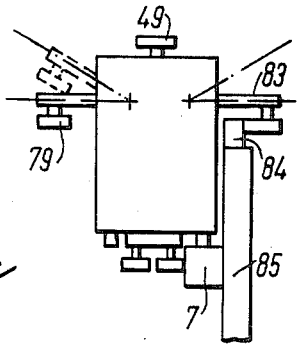
Figure 11:
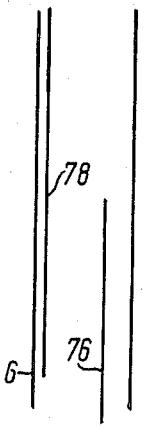
Figure 12:
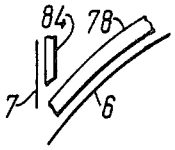
Figure 12:
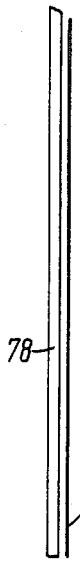
Figure 12:
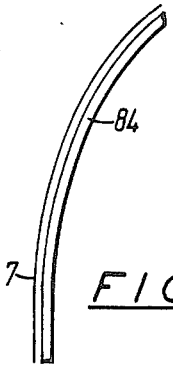
Figure 13:
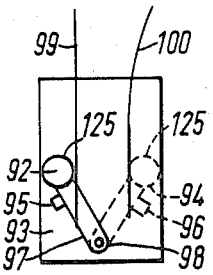
Figure 14:
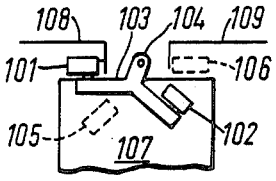

The following is a detailed description of embodiments of the invention, reference being made to the accompanying diagrammatic drawings in which:

FIG. 1 is a vertical section through a guideway and a vehicle,

FIG. 2 is a schematic plan of a junction in a track for the vehicle shown in FIG. 1, FIG. 3 is a longitudinal section through a vehicle, showing one rail beam, FIG. 4 is a plan view of a vehicle, showing the arrangement of the support and guide wheels, doors and seating, FIG. 5 is a section on the line A—A of FIG. 2 with the vehicle switching left, FIG. 6 is a section on the line B—B of FIG. 2, FIG. 7 is a section on the line A—A of FIG. 2, with the vehicle switching right. It also shows means for the vehicle to operate on a different sort of guideway when the vehicle travels cantilevered from the side of a guideway wholely to its right, FIG. 8 is a diagram in a vertical plane, showing the forces acting upon the vehicle shown in FIG. 5, FIG. 9 is a vertical section showing a modified form of vehicle cantilevered from the left, FIG. 10 is a vertical showing a vehicle cantilevered from the right, FIG. 11 is a plan view of a section of guideway following a divergent junction, FIG. 12 is a plan view of a divergent junction for on-board switching leading into two cantilevered tracks, FIG. 13 is a plan view showing a vehicle similar to that in FIGS. 1 to 8, but modified for onboard switching, FIG. 14 is a part vertical section of a vehicle showing an alternative construction which functionally resembles that shown in FIG. 13.

Figure 15:
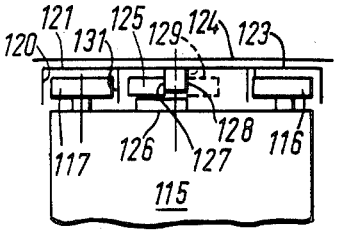
Figure 16:
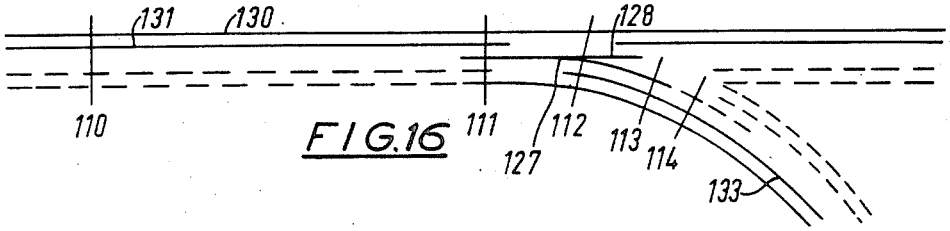
Figure 17:
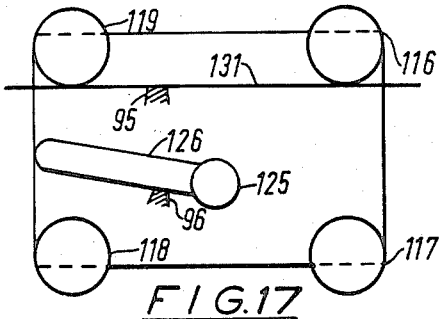
Figure 18:
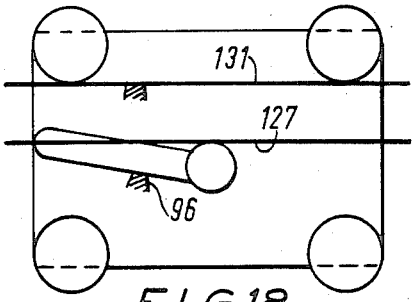
Figure 19:
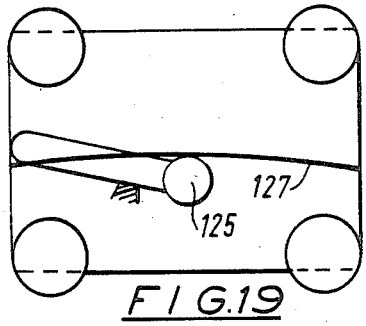
Figure 20:
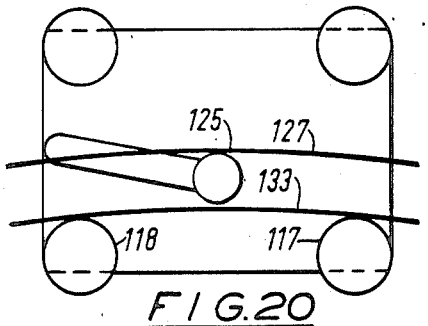
Figure 21:
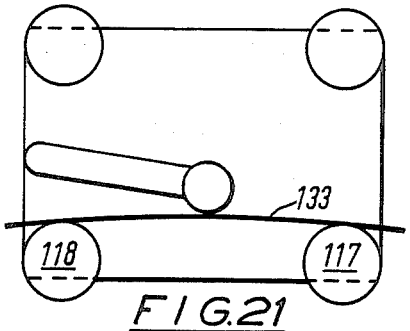
Figure 22:
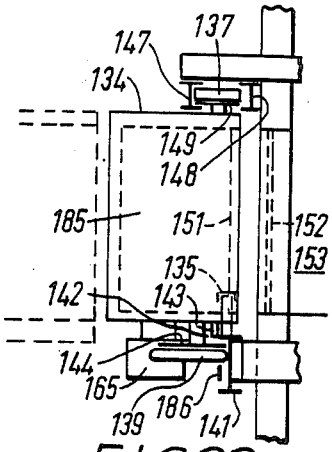
Figure 23:
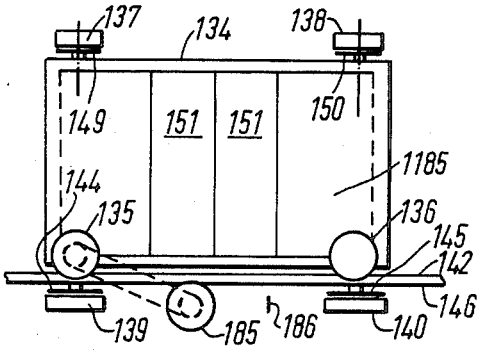
Figure 24:
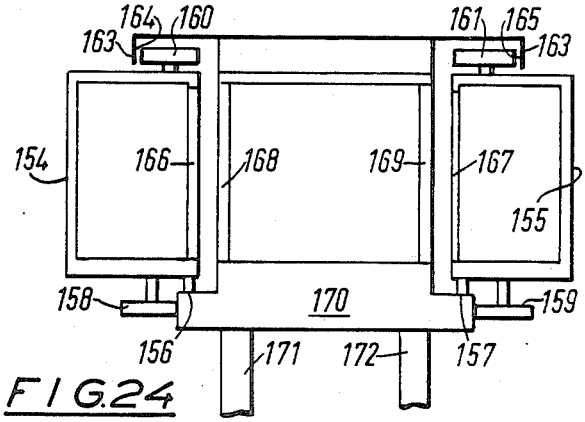
Figure 25:
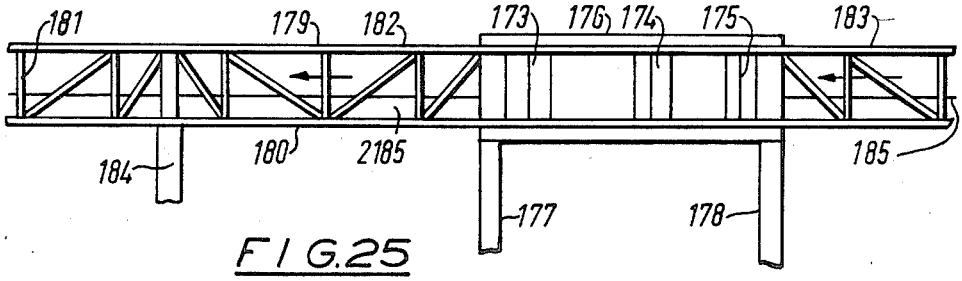
Figure 26:
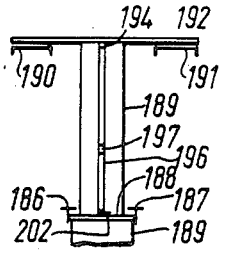
Figure 27:
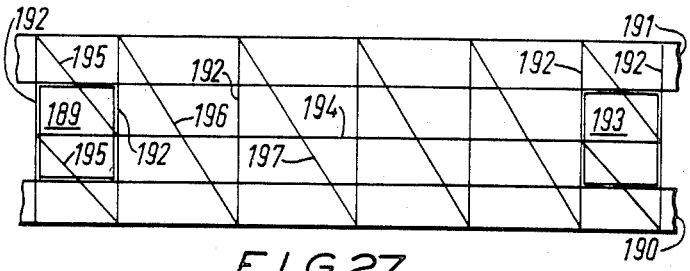
Figure 28:
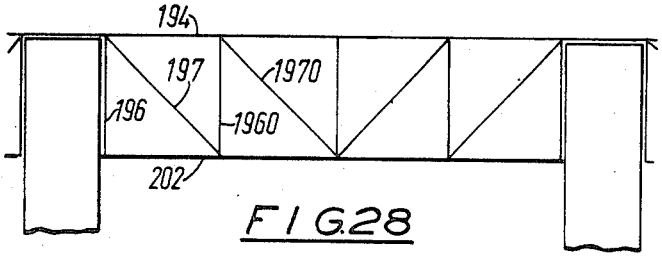
Figure 29:
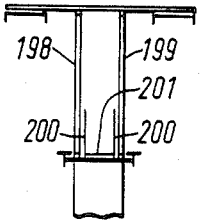
Figure 30:
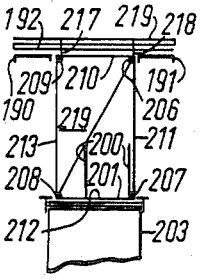
Figure 31:
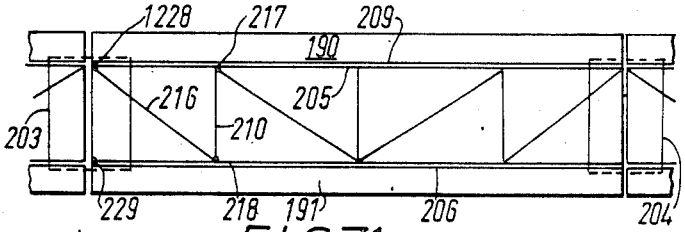
Figure 33:
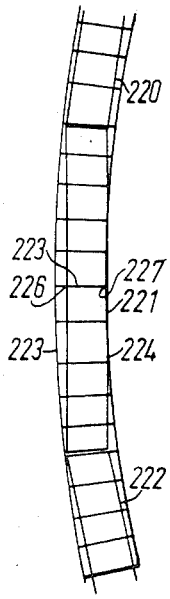
Figure 32:
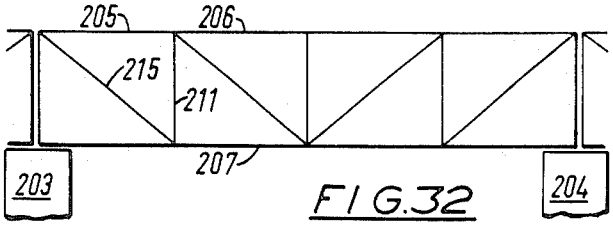

FIG. 15 is a part vertical section through the upper portion of a vehicle and guide surfaces which are provided according to another feature of this invention, FIG. 16 is a plan view of a divergent junction for the arrangement of FIG. 15, FIG. 17 is a plan view near the line 110 of FIG. 16, showing a vehicle on the guideway, FIG. 18 is a plan view near the line 111 of FIG. 16, showing a vehicle on the guideway, FIG. 19 is a plan view near the line 112 of FIG. 16, showing a vehicle on the guideway, FIG. 20 is a plan view near the line 113 of FIG. 16, showing a vehicle on the guideway, FIG. 21 is a plan view near the line 114 of FIG. 16, showing a vehicle on the guideway, FIG. 22 is a vertical section through a cantilevered vehicle according to another feature of this invention, which vehicle may optionally be provided with on-board switching, FIG. 23 is a side elevation of the vehicle and track shown in FIG. 22, FIG. 24 is a vertical section through a station, with two vehicles stopped there, being on journeys in opposite directions, FIG. 25 is a side elevation of the station shown in FIG. 24 also showing guideways leading thereto, FIG. 26 is a vertical section through a guideway according to another feature of this invention, FIG. 27 is a plan of the guideway shown in FIG. 26, the lower rail and some sleepers being omitted, FIG. 28 is a side elevation of the guideway shown in FIGS. 26 and 27, FIG. 29 is a vertical section through a modified guideway structure, FIG. 30 is a vertical section through another form of guideway structure, where four pin-jointed plane structures comprise a torque tube, FIG. 31 is a plan view of the structure shown in FIG. 30, the sleepers and lower rails being omitted, FIG. 32 is a side elevation of the main structural pat of the guideway structure of FIG. 30, FIG. 33 is a plane view of a curved section of track for the guideway structure of FIG. 30, showing the offsetting of rails.

Figure 34:
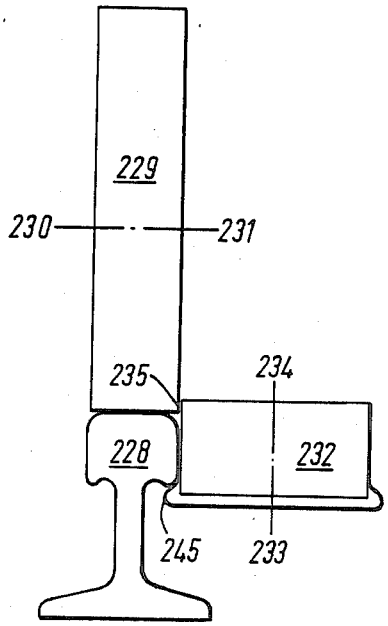
Figure 35:
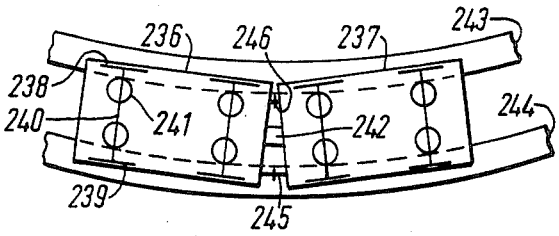
Figure 36:
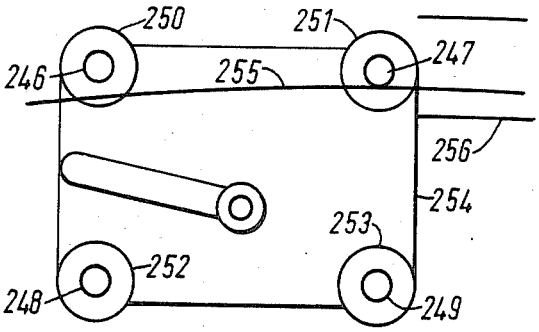
Figure 37:
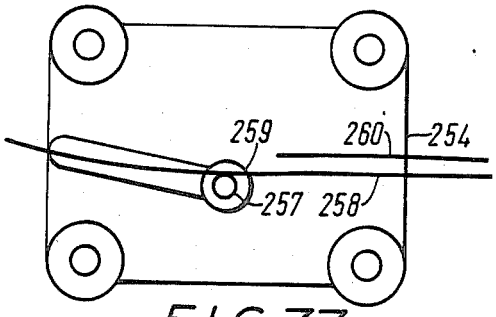

FIG. 34 is a vertical section through cylindrical steel wheels which may be used in arrangements according to the invention, one of which wheels optionally may be flanged, FIG. 35 is a plan view of two vehicles coupled together traversing a curved section of track, and FIGS. 36 and 37 are similar views to Figures 17 to 21 showing alternative forms of guide wheels.

FIGS. 1 and 3 show a vehicle and guideway whereby the vehicle is transversely located and stabilised according to this invention. As best seen in FIG. 1, the vehicle 1 is supported by two pairs of wheels, each pair being mounted on a solid axle. Wheels 2 and 3 are mounted on an axle 12 and there is another similar pair at the other end of the vehicle on an axle 38 (see Figure 3). Surface strips 4 and 5 provide running surfaces on I-beam longitudinal rail members 6 and 7. The support wheels 2 and 3 are pneumatically tyred and are provided with safety discs 8 and 9. These are engageable with check rails 10 and 11 to prvent derailment at junctions. The check rails may be joined to the I-beams (as shown) or to the running surfaces. Normal lateral guidance is provided by horizontal guide wheels 16, 17 mounted in pairs, each pair being substantially in the same vertical plane as the axle of one pair of support wheels. The guide wheels 16, 17 are also pneumatically tyred. The pneumatic tires on the support and guide wheels each allow sufficient lateral drift for the vehicle to be steered by the guide wheels without the necessity of means for angling the support wheels, this being made possible by the short wheelbase of the vehicle. Safety discs 14 and 15 are fitted above the guide wheels 16 and 17 respectively. The guide wheels 16, 17 and safety discs 14, 15 are freely mounted on vertical shafts 20, 21, which shafts may be rigidly mounted on the vehicle. The safety discs may be attached to the guide wheels or may be separately mounted.

Part of each safety disc 14, 15 underlies the upper horizontal flange of the associated I-beam and prevents vertical displacement of the vehicle from the I-beams, thus preventing derailment or overturning of the vehicle.

Power distribution rails 22 and 23 may be mounted beneath the guide wheels and engaged by collectors 24 and 25. Similarly, signal rails 26 and 27 may communicate with vehicle mounted receivers 28 and 29. If desired, linear motors 30 and 31 may also be situated beneath the support surfaces of the I-beams, and between their webs, to engage conductor strips 32 and 33 and obtain their tractive effort therefrom.

As shown in FIG. 3, a lower portion 34 of the vehicle extends beneath the support surfaces and between the I-beams. The floor of the vehicle upon which passengers stand is indicated at 35 and seats 36 and 37 cover the axles 12 and 38. A traction motor 39 drives shaft 38 through a toothed belt 40.

FIG. 1 also shows protective angle-section beams 41 and 42, which are so situated that they take the wear of the guide wheels 16, 17 rather than allowing the wheels to wear the surfaces of the main structural I-beams. The horizontal surfaces of the beams 41, 42 are engageable by the safety discs 14, 15 fitted to the guide wheels.

FIG. 4 shows also horizontal guide wheels 43 and 44 at the opposite end of the vehicle, and sliding doors 45, 46, 47 and 48.

It will be seen that the guideway and vehicle system which has been described provides admirable transverse location, stability against rolling, a neat, economical and attractive guideway structure, protection for conductors and signal rails and a clear floor space for the passenger compartment of the vehicle, together with low cost mechanical construction, and excellent access and egress. Special provisions are required for switching the vehicles at junctions and such provisions will now be described.

Referring to FIGS. 1 and 4, a solid tired idler wheel 49 is mounted in the centre of the specially strengthened roof of the vehicle. The wheel 49 is freely rotatable on its shaft, the axis of which is vertical.

Referring to FIG. 2, the pitch lines of the rails 6 and 7 diverge as they extend past the apex of a junction. A vehicle passing the junction is kept upright and guided by engagement of the wheel 49 with either of two switch surfaces 50 or 52 on a switch member 51 pivotally mounted over the guideway so as to lie above the roof of the vehicle, as shown in FIG. 1. When the switch member 51 is engaged by the wheel 49, there is a slight lead-in ramp (not shown) and the vehicle is thereby fractionally tilted, for example, towards the right. To facilitate this inclination, the top portion of the angle beam 41 is thinner than that of the angle beam 42. This allows the wheels 16 and 43 to lift fractionally. At approximately the same location on the guideway, the check rails 10 and 11 on the inner edges of the I-beams are discontinued. The vehicle is then held to one side by the reaction exerted by the switch member 51 on the wheel 49. This guides each vehicle past the junction until it is supported on both sides again.

A fixed guide surface 53, which forms a temporary fixed continuation of the switch member 51 along the right hand guideway, is discontinued shortly after the junction, at position 54. When in the position shown in FIG. 2, the switch member 51 is supported by its vertical pivot shaft 55 and by a stop 56. Alternatively, the switch member 51 may be pivoted to the position represented by the broken line at 57 in FIG. 2, so that vehicles are then routed to the left at the junction and a stop 62 supports the switch member. FIG. 5 also shows the switch member 51 in the position indicated by the broken line 57 of FIG. 2. It will be noted that the vehicle is kep upright by the upper guidewheel 49 engaging the switch member 51, and that it is cantilevered from the left.

After the position indicated at 59 in FIG. 2, an I-beam rail is again provided on both sides of each guideway beyond the junction. The said further I-beams are indicated at 60 and 61 respectively.

Referring to FIG. 6, a vehicle such as that shown in FIG. 1 is provided with bottom support on both sides, by four wheels. The rail I-beams 6 and 7 are supported on a trellis structure comprising spaced uprights 67 joined by a transverse tie member 68. Such members 67, 68 form arches supporting the longitudinal rail members, which span the distance between the arches.

FIG. 7 shows the vehicle cantilevered from the right. It will be noted that it is supported by two of the same support wheels as in FIG. 6, but on one side only, and that it is kept upright by engagement of the wheel 49 with the switch member 51.

A vehicle which is cantilevered from the left or from the right, as in FIG. 5 and 7, to pass through the junction, may continue to be supported in that manner beyond the junction. The switch member 51 may then be replaced by a fixed rail or guide, designated 70 in FIG. 7, (represented by the same component as the switch member 51). The rail 70 may be supported by structural members such as a transverse beam 71 and a column 69. The column 69 may also support the rail beam, such as 7 or 6.

Referring to FIG. 8, the weight 71 of a vehicle, cantilevered from the left, acts downwards through the centre of gravity 72 and this force is balanced by the upward supporting force 73, with moment arm 74. The forces are equal, and produce a resultant couple equal to either 72 or 73 acting at distance 74. This couple is balanced by that of the guide forces. The top of the vehicle is held in, thereby keeping it upright, by force 75 acting (for example) on the wheel 49. This is balanced by the forces on the lower guide wheels 16 and 43 (see FIG. 4), acting outwards with a force which will be equal and opposite to 75, (in the absence of disturbing loads, such as transverse winds and/or centrifugal force). Each said horizontal force acts on a moment arm 77 producing a couple acting in the opposite direction to that produced by the weight and vertical reaction. Since 75 automatically adjusts to the applied load, these two couples automatically balance. Wind and centrifugal loads are carried by additions to or subtractions from loads 75 and 76, so that their algebraic sum is unchanged—i.e. a force of one Newton acting from left to right through the centre automatically causes one half that force to be added to the load 76 and one half to be subtracted from 75. Couples produced by wind will be automatically compensated by changes in the value of both loads 75 and 76.

The guide member, such as 70 in FIG. 7, requires an overhead supporting structure, and this may be eliminated if side followers are provided, as in FIGS. 9 and 10. FIG. 11 represents a section of guideway, for movement of vehicles from bottom to top. Initially, the vehicles are supported on the rail 6 and kept upright by the upper guide rail 70. Subsequently, an additional side guide rail 78 is provided. This is engaged by another follower 79 (see FIG. 9) and the upper guide is discontinued after a short overlap. As shown in FIG. 9, the side follower member 79 may comprise a wheel 80 idling on a shaft carried by an arm 81. The guide 78 may comprise a rail attached to spaced columns such as 82, which also carry the support rail 6. The side follower may be duplicated at the front and back of the vehicle respectively, and it is only necessary at one side, if it is desired to cantilever the vehicle from one side. However, if it is desired to be able to cantilever the vehicle from either side, then another (optionally duplicated) side follower, such as 83, may be provided. FIG. 10 shows how the vehicle may be cantilevered from the right, being guided and kept upright by the follower 83, engaging a rail 84 which is supported by a column 85 which supports the right hand track rail 7.

On-board switching may replace on-guideway switching as described above. For example, the side followers 79 nd 83 may be pivotably mounted about fore and aft axes 86 and 87, and articulated by on-board means, under computer control, so that either follower arm may take up the inclined position represented by the broken lines in FIGS. 9 and 10 and by the broken axis lines 86–88 and 86–89, also by broken lines 87–90 and 87–91.

When such pivoting means are provided, the rails 78 and 84 may continue through the junction, as shown in FIG. 12. The side guide rails 78 and 84 are provided before and through the junction, and vehicles reach the junction, travelling from the bottom to the top of the drawing, with bottom support from the track rails 6 and 7. Substantially before the junction, every vehicle selects either the guide 78 or the guide 84, and immediately before the junction each of these guides is biased slightly away from the centre of the guideway, so that a vehicle engaged with the guide 78 is tilted out of supporting engagement with the track 7, and is in fact cantilevered from the left before the tracks 6 and 7 diverge at the junction. Similarly, vehicles engaged with guide 84 are slightly tilted to the right, immediately before the junction is reached, so that they become supported only from the track beam 7. In each case, vehicles follow the tracks 6 or 7 respectively through the junction, and may continue cantilevered from the left or the right respectively. Optionally bottom support on both sides may follow the junction, as represented in FIG. 12 by the renewal of rails 6 and 7, and also the guides 78 and 84. Optionally the pivot axes of the followers on both sides may be coincidental and they may thus form one rocker member.

In FIG. 13, the vehicle 93 moves from the bottom to the top of the drawing. An upper guide wheel 125 is mounted on a crankshaft, comprising a shaft 98 and a web 97, which is movable by on-board means, whereby the guide wheel is movable between positions 92 and 94. Stops 95 and 96 limit the movement of the crankshaft. The crankshaft is moved before the vehicle 93 reaches a junction, and the guide wheel then engages one or other of upper guide members 99 or 100, which guide the vehicle to the appropriate side of the junction, and keep it upright.

In the arrangement of FIG. 14, upper guide wheels 101 and 102 are mounted on a rocker arm 103, which is pivotable on a shaft 104 and operated by onboard means, so that the wheels 101 and 102 may be moved to positions 105 and 106 respectively. Upper guide members 108 and 109 are stationary and correspond to the guide members 99 and 100 of FIG. 13, so that when the wheel 101 engages the guide 108 the vehicle 107 is guided to the left at a divergent junction which follows, and when the wheel 102 engages the guide 109, it is guided to the right. In both cases the vehicle is kept upright by the wheel at the time in engagement with its appropriate guide.

FIGS. 15 to 21 show an alternative arrangement whereby on-board switching can be pre-set and verified before reaching a junction and while the vehicle remains cantilevered from one side. Instead of requiring a length for verification, with bottom support, at the junction, together with a safe emergency stop length which safety otherwise requires, this feature needs no more than an assured continuity of guidance, with overlaps of up to one vehicle's length. Safety is enhanced by providing for normal operation (except when actually passing junctions) on fixed axis upper guide wheels. This embodiment is made possible by small guide wheels which have been found to be commercially available, to meet the load and speed requirements. For example, for a 16 passenger vehicle, the guide wheels may be 15 in. (38 cms) or 16 in. (40.5 cms) diameter. The 16 ins diameter would be suitable for the fixed axis wheels for continuous use. The 15 inch diameter would be suitable for the articulated wheel.

FIG. 15 shows a vertical section through the upper portion of a vehicle 115, provided with four fixed axis guide wheels 116 to 119. These guide wheels idle on shafts mounted on the upper portion of the vehicle, with vertical axes. In the vicinity of a junction, e.g. at the position of line 111 in FIG. 16, there is provided a guide surface 131 which is engaged by wheels 117 and 118, which both guide the vehicle and keep it upright. The guide surface 131 is provided on one side of an inverted channel track member 121 which embraces the guide wheels, whereby any reversal of transverse load, such as might be caused by wind, centrifugal force, or accident conditions, is carried by the opposite guide surface of said member 121. A similar track member 123, for wheels 116 and 119, is shown in elevation. It will be understood that both members 121 and 123 would be provided for an overlap change-over from cantilever from one side to cantilever from the other, but not normally at the same place under any other conditions. The members 121 and 123 are supported on transverse upper beam 124.

The vehicle may be provided with bottom support from one or both sides, as has been described. Nearcentral guide surfaces 127 and 128 are provided for the articulated wheel 125, which is movable to an alternative position 129, as shown in broken lines in FIG. 15. The operation may be as follows. Vehicle movement is from left to right of FIG. 16.

On approaching a junction, FIG. 16, a vehicle at position 110 is cantilevered from the left, with bottom support on that side only, the axis of the left hand support rail being indicated at 130. The vehicle is guided and kept upright by engagement of the upper guide wheels 116 and 119 with the left hand upper guide surfaces 131, as shown in FIG. 17. At this position the crankshaft 126 is free to move, and during the approach period, as soon as possible after leaving the last junction, it is moved to the position required for the oncoming one. This movement is verified and an automatic stop proceeds should correct operation fail to be verified.

On reaching position 111, the central upper guide surface 127 is provided. This is engaged by the wheel 125, loading the crankshaft against the stop 96, and very slightly tilting the vehicle to the right, so that there is no shock when its left hand support wheels leave their rail. At this stage the vehicle is bottom supported from both sides, with load being transferred from left to right. Shortly afterwards, the guide 131 is discontinued, so that, whichever side has been selected by the guide wheel 125, the vehicle can follow it.

FIG. 19 shows the conditions at position 112 of FIG. 16. It will be noted that there is no guide 131. Top guidance is effected solely by the guide 127 acting on the wheel 125. Should the vehicle have switched left, the wheel 125 will have followed the left hand surface of the guide 128 (FIG. 16).

FIG. 20 shows the vehicle near position 113 of FIG. 16. The upper guide surface 133 is engaged by the fixed axis guide wheels 117 and 118. The guide 127 is subsequently discontinued and the vehicle remains under the guidance of the wheels 117 and 118, acting on the surface 133.

Support is as follows. In FIG. 17 the vehicle is cantilevered from the left. In FIG. 18 bottom support is provided on both sides, while load transfer is taking place. In FIGS. 19, 20 and 21 the vehicle is cantilevered from the right.

A corresponding sequence is followed by vehicles branching left, and at convergent junctions. Vehicles may change from cantilever left to cantilever right, and vice versa with no more than a length of bottom support track long enough for shock free load transfer.

Furthermore, at convergent junctions, fixed guide blades may engage the crankshaft mounted guide wheel 125, to move it, if necessary, to ensure that it is correctly positioned.

In the arrangement of FIGS. 22 and 23, the vehicle 134 is carried by two support wheels 135 and 136, being cantilevered outwards therefrom and kept upright by upper guide wheels 137 and 138. The reaction from those wheels is balanced by two lower guide wheels 139 and 140. The support wheels run upon surface members (not shown) over rail and structural member 141. This is an I-beam, web vertical, the upper flange of which supports the wheels. The vertical flange of an angle section check rail 142 prevents derailment by engaging a safety disc 143 which is coaxial with the wheel and rotates with it.

The lower guide wheels 139 and 140 idle about vertical axes, running against the web of the I-beam. They are provided with safety discs 144 and 145. These are engageable with the underside of the top flange 146 to prevent the support wheels from lifting over the check rail 142.

The upper guide wheels 137 and 138 idle on vertical shafts rigidly joined to reinforcements in the roof of the vehicle. They run on the web of the I-beam 147. They are provided with safety discs 149 and 150 which are engageable with the lower flange of the I-beam 147, to prevent derailment. Reverse loading upon the upper or lower guide wheels may be created by transverse strong winds and/or collision conditions on curves. On the upper guide wheels, such loads are carried by the engagement of the other sides of the wheels 137 and 138 with a second upper track member 148. On the lower guide wheels, the loads are carried by the engagement of the safety discs on the support wheels with the check rail.

FIG. 22 shows, in broken lines, a sliding door 151 on the vehicle 134 and a precisely located door 152 in the wall facing it. A station may be provided to the right of the wall, at 153. Thus access to the vehicles is between the upper and lower rails.

FIG. 24 shows a double-sided station. Vehicles 154 and 155 ride on tracks 156 and 157. Lower guide wheels 158 and 159 run over the outer surface of the track members. The upper guide wheels 160 and 161 are horizontal, just above the roof of each vehicle, and attached thereto, so that their outer edges are substantially on the same plane as the vertical inner wall of the vehicle. Their inner edges engage vertical track surface members 162 and 163, which overhang the tops of the vehicles and are secured to transverse beams 164, 165. Doors 166 and 167 align with stationary doors 168 and 169. The station platform 170 is supported on columns 171 and 172.

FIG. 25 shows three sets of sliding doors, 173, 174 and 175, in the vertical wall of the station 176, which is supported on columns 177 and 178. The upper guide rail (corresponding to member 147 of FIG. 22) is indicated at 179, and the lower guide and support rail (corresponding to member 141 of FIG. 22) is indicated at 180. These members are continuously parallel throughout the approach to the station, the station itself and the following section of track structure. Spans 181, 182 and 183 connect with the station. Each comprises upper and lower rail members 179 and 180, with vertical struts and diagonal cross bracing. The vertical struts are more closely spaced at the end of each span than in the centre, for reasons of appearance, and the spans are supported on columns such as 184, 177 and 178.

In FIGS. 22 and 23 a traction motor 185 is mounted beneath the floor of the passenger cabin 1185, and lower than the point of contact of the support rail with the support wheels. The axis of the output shaft of the motor is parallel to the axes of the support wheels and drives one of the support wheels by means of a belt. This leaves the floor space clear, and is conveniently situated for power collectors, which may also be situated beneath the floor as indicated at 186 in FIG. 22.

The station and sections of track shown in FIG. 25 may be double-sided, as in the station in FIG. 24, so that traffic in the far side travels in the opposite direction to that on the near side. A walkway may be provided between the two tracks as represented by handrail 2185. There may be provided special guideway structures as follows.

Referring to FIG. 26, T-shaped rails 186 and 187 carry the weight of the vehicles passing respectively on either side of the structure, and their vertical surfaces provide guide surfaces for the lower horizontal guide wheels, generally as has been described. The rails are supported by transverse sleepers such as 188, which themselves may conveniently be joined by horizontal longitudinal structural members, such as 202. Where appropriately situated, each sleeper may directly rest upon a step in the vertical support column, such as 189. These columns are also connected by upper guide rails 190 and 191, which may be joined thereto by transverse sleepers such as 192.

In the arrangement of FIG. 27, columns 189 and 193 pass through the lower composite beam (to be described) and locate an upper composite beam through sleepers such as 192 and upper guide rails 190 and 191. The columns are effectively rigidly joined to said upper horizontal composite lattice braced flat beam, comprising said sleepers, said upper guide rails, main longitudinal structural member 194, which may conveniently be situated on the centre line, and diagonal bracing members such as 195, 196 and 197. Thus the horizontal loads imposed by cantilevered vehicles upon the upper guide rails 190 and 191 are carried by said composite beam and transmitted thereby to the tops of the columns 189 and 193.

The horizontal loads imposed by the lower guide wheels upon the vertical sides of the rails 186 and 187 are carried by similar latice braced flat horizontal beams comprising said rails, main horizontal lower structural member 202 and suitable lattice bracing such as diagonal members corresponding to those shown in FIG. 27.

The vertical loads imposed by the weights of vehicles upon the rails 186 and 187 are carried by a centrally disposed composite lattice braced beam comprising the two aforesaid longitudinal structural members, 194 and 202, suitable spaced vertical beams such as 1960, and diagonal cross bracing members such as 1970.

It will be appreciated that the columns must extend to the top of the structure in order to locate the upper flat beam transversely, and that the rails must therefore pass to either side of them, being offset from the centre line generally as shown in FIG. 26 and Figure 28. Thus the weight of vehicles produces a couple which is carried as a bending moment in the lower transverse sleepers. These are bracketed (i.e. provided with joints capable of tranmsitting the said couple) to vertical beams, such as 1960 and through them to the upper composite flat horizontal beam, as generally shown in FIGS. 26 and 27. This couple thereby produces a pair of equal and opposite transverse forces, in said upper and lower composite horizontal beams respectively. Said couples may be transmitted longitudinally by the two composite horizontal beams to the vertical columns and ultimately thereby to the ground.

FIG. 29 shows an alternative embodiment of the invention whereby the vertical composite beam (generally as shown in FIG. 28) is duplicated. In this case the side elevation generally resembles FIG. 28 and the two vertical composite beams are as represented by 198 and 199 in FIG. 29. The vertical members corresponding to member 1960 remain beams carrying the couple produced by the sleepers. Said couple may either be transmitted by said vertical beams both sides, whereby both help to carry the weight, or alternatively, if only one side is carrying a vehicle or vehicles, the vertical composite beam one side may carry the load, acting upwardly, and the other vertical beam may act downwardly upon the other ends of the sleepers (i.e. the ends opposite to the ends carrying the load of the vehicle or vehicles) in order to carry the said couple due to the rail being cantilevered beyond the upwardly acting beam.

If desired for maintenance purposes, and/or for any other purposes such as an emergency escape route for passengers from any broken down vehicle or vehicles, a pedestrian walkway may be provided between the vertical beams 198 and 199. This may have balustrades, such as 200 and a deck 201 may be fitted between the two vertical composite beams.

According to another embodiment of this invention, shown in FIGS. 30 to 33, there may be provided a track structure carrying vehicles as aforesaid, whose spans are rectangular torque tubes formed from four pin-jointed plane structures, which torque tubes are secured to the plane top surfaces of columns.

With reference to FIGS. 30 to 33, it must be explained that the term "pin jointed" is derived from analytical considerations, whereby structures of the type considered may be stressed in a manner resembling those which would exist if pin joints, or more truly, ball and socket joints, were fitted at the ends of each strut ore stay. Moreover, main longitudinals may be considered to be fitted with ball and socket joints (for purposes of stress consideration) wherever they are joined by transverse members and/or diagonals.

In this sense "pin-jointed" means that the structural members are subject principally to forces acting in compression or in tension along their axes. A "torque tube" means a structure comprising a tube, whose walls may be composite pin-jointed structures, and which is designed to transmit torque.

Columns 203 and 204 carry discrete guideway members such as 205. Each said beam comprises four main longitudinal structural bars, such as 206, 207, 208 and 209. These may, for example, comprise structural steel joists, tubes or extruded light alloy tubes. Their axes lie virtually at the corners of a rectangle, as shown in FIG. 30. All four are connected at intervals, in spaced transverse planes, by four transverse members, such as 210, 211, 212, and 213 and by a diagonal stay member (which may also serve in compression) such as 214. These transverse frames are joined by diagonals each side, such as 215, and by diagonals top and bottom such as 216. Rails, as described above, may be attached by sleepers top and bottom, which sleepers are secured to attachment points such as 217 and 218.

In order to provide visual coherence to the structure as a whole, and also to eliminate the unsightliness of track members against the sky, a roof such as 219 may be fitted. In addition, a pedestrian walkway may be fitted within the structure, with balustrades such as 200 and a deck such as 212. It is noteworthy that there is enough room under the diagonal member 214 for people conveniently to walk along the walkway.

FIG. 33 shows how this structure is adaptable for curves. Spans of straight guideway structures 220, 221 and 222, lie along chord lines, with mitred ends. Curved rails such as 223 and 224 are secured thereto by offset sleepers such as 225, to the mounting points provided at the transverse frames of the beams, such as 226 and 227.

It will be noted that the four longitudinal structural bars, together with cross frames and diagonals such as 216, which lie in the planes of the sides of the rectangle at whose corners the main longitudinals lie, form a torque tube. The cantilevered sleepers carry a couple from the rails and this is applied to the central portion of the said torque tube, when loaded there, at one side. It is carried by the torque tube to its ends, and there transmitted to the top of the columns, through anchorage points such as 1228, to the columns such as 203. This torque would tend to distort the torque tube into a lozenge or parallelogram shaped cross-section, but such distortion is prevented by diagonals such as the member 214.

In connection with the guideway shown in FIGS. 30 to 32, it will be noted that the upper lattice braced beam effectively transmits the outwardly acting load from a vehicle longitudinally to the vicinity above the support columns.

In connection with FIGS. 26 to 32, the terms horizontal beam and vertical beam refer to the major axes of their cross-sections. It will be seen that the provision of the horizontal beam at the top of the guideway structure reduces the tendency for the top to be twisted sideways at the centre of a span.

A vehicle as described herein may be provided with bottom support through four cylindrical steel wheels and four cylindrical guide wheels as shown in FIG. 34. The steel rail 228 supports a cylindrical wheel 229, which is located by and rotates with a long axle whose axis of rotation is indicated at 230, 231. This axle may carry support wheels such as 229 at both sides of the vehicle, as in conventional railway practice. However, in order to carry the relatively high transverse loads which may be associated with cantilevered operation as herein described, instead of using conventional flanged wheels, lateral guidance is provided by separate cylindrical steel guide wheels, such as 232, which are mounted upon a long, well supported axle whose vertical axis of rotation is indicated at 233–234. It is preferable that the surface of this wheel is parallel to the side surface of the rail 228 upon which it bears. It is not necessary that the axes 230–231 and 233–234 should lie in the same plane, but this may be preferable in order to keep the support wheels in the centres of the rails on curves. Wheels 229 and 232 may abut in the region of 235, where the relative motion will be small or zero. Advantages of this embodiment are that steel wheels are very much smaller and wear less than pneumatic tires and in particular it may be preferable to use steel wheels for guidance purposes. This embodiment is especially suitable for switching as described herein, whereby the cantilever support is used for switching of bottom supported vehicles, because the cylindrical guide wheels are preferable to flanged wheels, and this method of switching eliminates the reduced clearances through which flanges have to pass on conventional railway switches.

FIG. 35 shows the general instance of a train of bottom-supported vehicles which may be provided according to this invention. Two vehicles 236 and 237 are each supported upon two pairs of wheels, such as 238 and 239, which are mounted in pairs upon solid axles such as 240—i.e. the wheels do not rotate on the shaft, the shaft rotates and is axially located in bearings. Rectangular plinths 243, 244, or I-beams are provided for these support wheels to run upon, and for guidance. Each said vehicle is guided by four horizontal wheels, such as 241, whose axes of rotation may intersect those of the nearest support wheels. Two adjacent such vehicles are coupled with an axis of pivoting indicated at 242.

Guide wheels such as 232 (FIG. 34) may optionally be provided with flanges, such as 245, which may engage the underside of the rail head, positively to preclude derailment. It is noteworthy that switching as described herein by cantilevering the vehicles remains possible, because the wheels on the opposite side may draw clear (e.g. by a slight increase in gauge) as the cantilever support is caused to become operative.

In the form shown in FIG. 35, damping may be provided in connection with the pivoting of adjacent vehicles relative to one another, about a vertical axis. Such damping may be applied to the coupling at 242, or alternatively it may be applied through buffers, such as 245 and 246, which are offset from the centre line. Such damping is to ensure stability against transverse oscillations about vertical axes, especially at high speeds.

FIGS. 36 and 37 show a modified version of the arrangement described with reference to FIGS. 17 to 21, in which there is provided a pilot wheel coaxial with each guide wheel, whereby said vehicle is steadied before the engagement of the guide wheel with the fixed guide surface, and the guide wheel is also spun up before engagement.

FIG. 36 shows fixed axis guide wheels 250 to 253, provided with respective pilot wheels 246 to 249 coaxial therewith. As the vehicle 254 moves from left to right, it is steadied, before the guide wheel 251 engages the fixed guide 256, by the engagement of the pilot wheel 247 with a pilot surface 255, which is provided with lead in. The engagement of the pilot wheel with the pilot surface also imparts angular acceleration to the guide wheel 251, whereby its shock on engagement with the guide 256 is reduced.

FIG. 37 shows a pilot wheel 257 coaxial with the crankshaft mounted guide wheel 259, which pilot wheel is engageable with a pilot surface 258, which is provided with a lead in, as shown. This steadies the vehicle, ensuring correctly located engagement of the guide wheel 259 with the guide surface 260, while the guide wheel 259 is given some degree of angular acceleration prior to engagement, whereby wear and shock are reduced.

It is noted that the pilot wheels may be above the level of the guide wheels, and, being smaller, there is enough room for adequate lead in. There may not be enough room for adequate lead in on the guide surface of the larger wheels.

In this specification, the term "bottom support" means support applied to the vehicle beneath the level of the floor of the cabin, or load carrying compartment, and not necessarily below the lowest extremity of the vehicle.

When not otherwise specified or made clear, the term "guideway" means the rails and the structure and/or foundations supporting them. The term "rail" means the member over which the wheels or their equivalent run. It may optionally be protected by a surface member. "Specific load" means the load per unit length (e.g. Newtons or kilograms force per meter). "Coned wheels" includes wheels which are both coned and flanged. "Capacity" means the passenger carrying capacity, for example in passengers per hour in one direction. "Support" signifies weight carrying, acting vertically. "Guidance" signifies horizontal forces to constrain the vehicle to follow the track and to remain correctly orientated transversely.

"Sleepers" signify transverse beams connecting the rails to the main structure of the guideway. "A plane structure" signifies one whose general shape resembles a plane or strip—e.g. the flange of an I-beam, whether comprising a solid strip of metal, or a flat composite lattice braced structure or any such form. A "beam" is a structural member designed to carry a couple acting about an axis perpendicular to its length. A "railhead" is a bulk of metal whereby Hertzian stresses are distributed in depth, as in 228 of FIG. 34.

"I-beam" means any body or structure the cross-sectional shape of which resembles the capital letter "I", for example comprising two plane horizontal strips or flanges joined together by a vertical web, and includes hollow and frame structures as well as solid beams.

I claim:

1. Means of transportation comprising a guideway and at least one vehicle, including an integral load-carrying compartment, traversing said guideway, the guideway including a divergent junction and selectively operable switching means being provided to direct the vehicle to follow either the left hand or right hand path out of the junction, said vehicle including bottom support means adjacent the bottom of the load-carrying compartment and at both sides of the vehicle for engagement with lower support rails on the guideway, and cantilever support means for engagement with upper guide surfaces provided on the guideway, said cantilever support means being duplicated on both sides of the vehicle and including one and the same upper follower, for engagement with an upper guide surface on the guideway, common to both said cantilever support means so that the vehicle may be supported in cantilever fashion from either side on a single lower support rail and a single upper guide surface, the divergent junction including a selection portion having only two lower rails which are initially simultaneously used for bottom support of the vehicle at both sides and which consist of a left hand lower rail extending continuously and only into the left hand path out of the junction and a right hand lower rail which diverges from the left hand rail and extends continuously and only into the right hand path out of the junction, the aforesaid switching means directing the vehicle to follow a selected one of said lower rails so that as the vehicle traverses the selection portion of the junction the bottom support means at one side of the vehicle remains in engagement with its associated lower rail while the bottom support means at the other side of the vehicle is brought out of engagement with its associated lower rail, the selection portion of the junction also including upper guide surfaces one of which is engaged by the cantilever support means of the vehicle, whichever path out of the junction is selected by the switching means, in such manner that the vehicle is supported in cantilever fashion by said one lower rail and said upper guide surface as it traverses said selection portion of the junction, the guideway further providing, upstream of said selection portion of the junction, and downstream thereof, in each path out of the junction, an upper guide surface and only one lower support rail at one side of the vehicle so that the vehicle is cantilever supported as it approaches and as it leaves the divergent junction, one of the lower support rails in the selection portion of the junction comprising a continuation of said lower support rail upstream of the junction and leading to the lower support rail in one path out of the junction and the other lower support rail in the selection portion leading to the lower support rail in the other path out of the junction, the lower support rails in the selection portion being parallel in an initial stretch of the selection portion so as to provide temporary bottom support at both sides of the vehicle as it traverses said initial stretch of the selection portion.

2. Means of transportation according to claim 1, wherein said common upper follower is an unchanging follower and the aforesaid selectively operable switching means comprise a movable track member mounted on the guideway at a divergent junction and selectively movable to engage one side or the other of said common upper follower so as to direct the vehicle to follow either the left hand or the right hand portion of the guideway out of the junction, depending on the position of the movable track member as the vehicle enters the junction.

3. Means of transportation according to claim 1, wherein said upper follower, common to both cantilever support means, is movable relatively to the vehicle for selective engagement with one or other of two upper guide surfaces on the guideway so as to direct the vehicle to follow either the left hand or the right hand portion of the guideway out of the junction, depending on the position of the movable upper follower as the vehicle enters the junction.

4. Means of transportation according to claim 3, wherein said upper follower includes a guide wheel rotatable about a vertical axis and mounted upon a crank-shaft which is pivotable through a predetermined angle between two limiting positions in which the axis of the guide wheel lies on opposite sides of a central vertical plane extending longitudinally of the vehicle.

5. Means of transportation according to claim 4, wherein the axis of the guide wheel lies substantially at the longitudinal mid point of the vehicle when the crank-shaft lies in either of said limiting positions.

6. Means of transportation according to claim 3, wherein each cantilever support means on the vehicle include, in addition to said movable upper follower, a further, unchanging upper follower which engages with an upper guide surface on the guideway when the vehicle is being supported in cantilever fashion by the respective cantilever support means and a single lower support rail.

7. Means of transportation according to claim 6, wherein each said unchanging upper follower comprises a guide wheel rotatable about a fixed vertical axis on the vehicle.

8. Means of transportation according to claim 7, wherein each said upper guide surface comprises the inner surface of one flange of a downwardly-facing channel-section member within and along which the unchanging guide wheel passes.

9. Means of transportation according to claim 6, wherein each cantilever support system on the vehicle includes a pair of unchanging upper followers, spaced apart longitudinally at each side of the vehicle.

10. Means of transportation according to claim 6, wherein the guideway in the vicinity of a divergent junction includes three portions, as follows:

(a) an upstream portion leading towards the divergent junction where said vehicle is cantilevered from one side by the aforesaid means engaging a lower rail on the guideway and said unchanging upper follower engaging an upper guide rail on the guideway, and during the traversing of which portion said movable upper follower is selectively operable freely in order to pre-select the left hand or the right hand side of said divergent junction substantially before said vehicle reaches said junction.

(b) a selection portion including two divergent upper guide surfaces wherein the movable upper follower necessarily engages the upper guide surface previously selected, whereby the vehicle is directed to commence to follow that side of the junction corresponding to the guide surface selected, said selection portion of the guideway also including two lower rails for engagement by the bottom support means on the vehicle to provide temporary bottom support for the vehicle at both sides as it commences to follow the side of the junction selected, and (c) follow-up portions on each of the right hand path and left hand path out of the junction wherein the vehicle is again cantilevered from one side by said means engaging a lower rail on the guideway and said unchanging upper follower engaging an upper guide rail on the guideway.

11. Means of transportation according to claim 10, wherein, in the follow-up portion on the left hand path out of the junction, the vehicle is cantilevered from the left hand side and, in the follow up portion on the right hand path out of the junction, the vehicle is cantilevered from the right hand side.

* * * * *